United States Patent [19]

Hobbs

[11] Patent Number: 5,033,805

[45] Date of Patent: Jul. 23, 1991

[54] DRAWER SLIDE ASSEMBLY WITH RELEASABLE LOCK MECHANISM

[75] Inventor: James D. Hobbs, Plainfield, Ind.

[73] Assignee: General Devices Co., Inc., Indianapolis, Ind.

[21] Appl. No.: 520,645

[22] Filed: May 8, 1990

[51] Int. Cl.[5] ..... A47B 88/00

[52] U.S. Cl. ..... 312/339; 312/333; 384/21

[58] Field of Search ..... 384/21; 312/341.1, 332, 312/333, 348, 334, 339

[56] References Cited

U.S. PATENT DOCUMENTS

| | | | |
|---|---|---|---|
| 3,039,838 | 6/1962 | Koch et al. | 312/348 X |
| 3,462,203 | 8/1969 | Del Vecchio . | |
| 3,521,939 | 7/1970 | Fall et al. . | |
| 3,650,578 | 3/1972 | Del Vecchio et al. . | |
| 3,904,254 | 9/1975 | Hagen | 312/348 |
| 3,923,347 | 12/1975 | Dean . | |
| 4,002,385 | 1/1977 | Hone | 312/348 X |
| 4,183,596 | 1/1980 | Greene et al. | 312/333 |
| 4,200,342 | 4/1980 | Fall . | |
| 4,272,139 | 6/1981 | Fler . | |
| 4,423,914 | 1/1984 | Vander Ley . | |
| 4,469,384 | 9/1984 | Fler et al. . | |
| 4,473,262 | 9/1984 | Staye . | |
| 4,549,773 | 10/1985 | Papp et al. . | |
| 4,560,212 | 12/1985 | Papp et al. . | |
| 4,610,487 | 9/1986 | Delmege et al. . | |
| 4,679,950 | 7/1987 | Delmege et al. . | |
| 4,696,582 | 9/1987 | Kasten . | |
| 4,749,242 | 6/1988 | Rechberg | 312/333 |
| 4,872,734 | 10/1989 | Rechberg . | |

*Primary Examiner*—Joseph Falk

*Attorney, Agent, or Firm*—Barnes & Thornburg

[57] ABSTRACT

A telescoping slide assembly includes a lock release member slidably positioned between a drawer slide member and an intermediate slide member. In response to movement of the drawer slide member outward to its extended position, the lock release member moves to break a locking connection between a cabinet slide member and the intermediate slide member that prevents relative movement of the intermediate slide member and a cabinet slide member. Breaking the locking connection between the intermediate slide member and the cabinet slide member allows outward movement of the intermediate slide member. The lock release member is desirably a bearing retainer slidably coupled to the intermediate slide member and configured to slidably support the drawer slide member.

19 Claims, 2 Drawing Sheets

DRAWER SLIDE ASSEMBLY WITH RELEASABLE LOCK MECHANISM

BACKGROUND AND SUMMARY OF THE INVENTION

This invention relates to telescoping drawer slide hardware that couples a drawer to a cabinet, and particularly to a lock release mechanism for use with a drawer slide assembly. More particularly, this invention relates to a telescoping drawer slide assembly having a lock mechanism for locking an intermediate slide member to the slide member mounted on a cabinet and means for unlocking the locking mechanism automatically in response to outward movement of the slide member attached to the drawer as the drawer is withdrawn from the cabinet.

Typically, a telescoping slide assembly is mounted in a cabinet to support a drawer or chassis for movement between a retracted position inside the cabinet and an extended position projecting outside of the cabinet. In most instances, a telescoping slide assembly includes at least three slide members. The first slide member is a stationary unit fixed to a cabinet and the second slide member is an intermediate unit extensible within limits from the stationary unit. The third slide member is extensible within limits from the intermediate unit and is the unit to which a drawer or electronic chassis is actually attached.

It is known to provide locking interconnections between each of the three slide members so that extension or retraction of the slide members relative to each other can be prevented. This allows drawers to be extended outward from the cabinet and locked to maintain a desired extended position. However, since these locking interconnections must generally be manually engaged and disengaged, separate manual unlocking actions are required before such drawers can be extended.

One object of the present invention is to provide a telescoping slide assembly having means that is actuated in response to outward movement of a drawer slide member to break automatically a locking connection between an intermediate slide member and a cabinet slide member so that outward movement of the drawer acts to break the locking connection automatically.

Another object of the present invention is to provide a telescoping assembly having lock release means for unlocking a locking mechanism blocking relative movement of the intermediate slide member and cabinet slide member in response to outward movement of the drawer slide member.

Another object of the present invention is to provide a lock release member that slides between the intermediate slide member and the drawer slide member as the drawer slide member is extended outward from the cabinet to break a locked connection between the intermediate slide member and a cabinet slide member in response to outward extension of the drawer slide member so that the intermediate slide member is free to move relative to the fixed cabinet slide member.

Still another object of the present invention is to provide a telescoping slide assembly having a drawer slide member that is slidable on a bearing support capable of breaking a locking connection between an intermediate slide member and a cabinet slide member, with the bearing support having ball bearings held in a ball bearing assembly attached to an intermediate slide member of the slide assembly so that the drawer slide member can be easily extended outward from the intermediate slide member while the ball bearings are retained in the intermediate slide member.

According to the present invention, a telescoping slide assembly is provided for supporting a movable drawer in a cabinet. The slide assembly includes a stationary cabinet slide member for mounting on the cabinet, a drawer slide member for carrying the drawer, and an intermediate slide member interconnecting the cabinet and drawer slide members. A locking mechanism is provided to form a locking connection between the intermediate slide member and the cabinet slide member. The locking mechanism is operable to block relative movement of the intermediate slide member and the cabinet slide member. A lock release member coupled to the drawer slide member is also provided to break the locking connection between the intermediate slide member and the cabinet slide member established by the locking mechanism in response to movement of the drawer slide member.

In preferred embodiments, the intermediate slide member includes a support bracket slidably connected to the cabinet slide member and an outer section fixed to the support bracket for movement therewith. The outer section is formed to include channel means for receiving the drawer slide member therein.

The lock release member is retained in the channel means of the intermediate slide member for slidably supporting the drawer slide member in the channel means. The lock release member is slidable relative to the outer section of the intermediate slide member from a starting position located near the cabinet to an end position located away from the cabinet. The lock release member includes a bearing race assembly includes a plurality of ball bearings that are arranged to engaged both the outer section and the drawer slide member. These ball bearings roll freely in the channel means formed in the outer section as the drawer slide member is extended and retracted with respect to the outer section.

In operation, the drawer slide member is moved outwardly from the cabinet by a person opening the drawer attached to the drawer slide member. The lock release member, situated in the channel of the intermediate slide to slidably support the drawer slide, moves outward from its starting position as the drawer slide is extended outwardly from the cabinet. At a predetermined point between its starting position and its end position, the lock release member engages a lock mechanism to break a locking connection between the intermediate slide member and the cabinet slide member, allowing the previously locked intermediate slide member to move relative to the cabinet slide member and extend outward from the cabinet.

One feature of the present invention is provision of a lock release mechanism that operates to break a locking interconnection between an intermediate slide member and a cabinet slide member in response to movement of the drawer slide member outward from a cabinet as the drawer is pulled outward. Advantageously, this feature enables one to automatically break the locking interconnection between the intermediate slide member and the cabinet slide member simply by pulling a drawer outward from a cabinet.

Another feature of the present invention is provision of a lock release member that slidably engages both an intermediate slide member and a drawer slide member to establish connection of the drawer slide member to a telescoping slide assembly mounted in a cabinet and further acts to break a locked connection between the intermediate slide member and a cabinet slide member. Advantageously, the lock release member in accordance with the present invention is easily incorporated into a channel defined by the intermediate slide member, and can act to break a locked connection between the intermediate slide member and a cabinet slide member.

Yet another feature of the present invention is the provision of a bearing support retained in the channel means of the intermediate slide member for slidably supporting a drawer slide member in the channel in a manner that permits removal of the drawer slide member from its connection to the telescoping slide assembly. Advantageously, the drawer slide member can be removed from sliding engagement with the outer section of the intermediate slide assembly without removing the support from the channel defined in the intermediate slide member. It has been observed that the bearing support can become contaminated with debris or particles that impede smooth sliding motion if the support is removed from the intermediate slide member upon disconnection of the drawer slide member from the rest of a telescoping slide assembly. Further, it is oftentimes difficult to install a drawer slide member on an intermediate slide member if ball bearings are carried by the drawer slide member as is known in the prior art.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
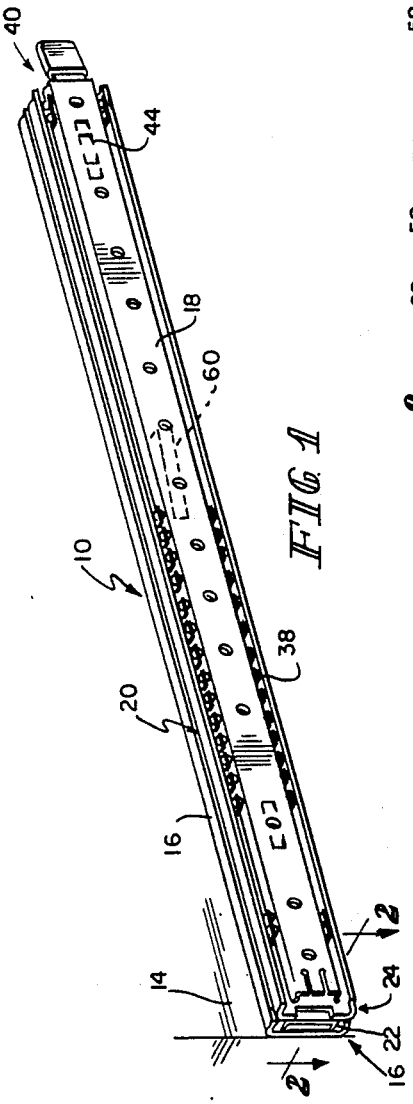
FIG. 1 is a perspective view of a telescoping slide assembly in a closed position showing a cabinet slide member mounted on a cabinet, a drawer slide member in locking engagement with the intermediate slide member, an intermediate slide member in locking engagement w cabinet slide member.
Figure 2:
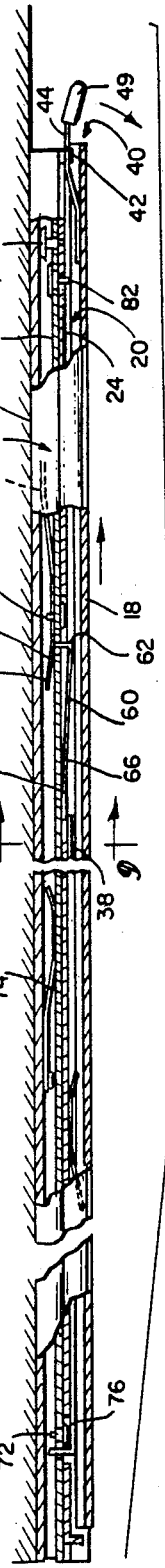
FIG. 2 is a sectional view taken along section 2—2 of the slide assembly shown in FIG. 1, with portions broken away.

Referring to FIGS. 1 and 2, a telescoping slide assembly 10 is provided for supporting a drawer (not shown) in a cabinet 14. The slide assembly 10 includes a cabinet slide member 16 permanently mounted in a stationary position on the cabinet 14, a drawer slide member 18 for carrying the drawer, and an intermediate slide member 20 including a support bracket 22 slidably connected to the cabinet slide member 16 and an outer section 24 fixed to the support bracket 22 for movement therewith.

Figure 5A:
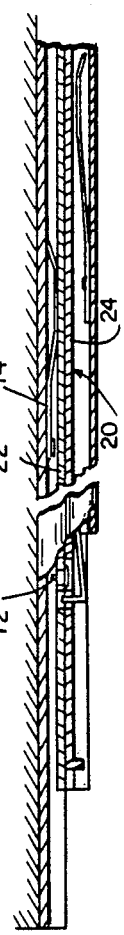
FIGS. 5A and 5B companion detail views of the slide assembly shown in FIGS. 2 and 4 that can be merged to show the ability of a bearing support for the drawer slide member to move to a predetermined position between the drawer slide member and the intermediate slide member and thereby release the locking engagement of the intermediate slide member and the cabinet slide member.
Figures 5B, 6, 7, 8, 9, 10:
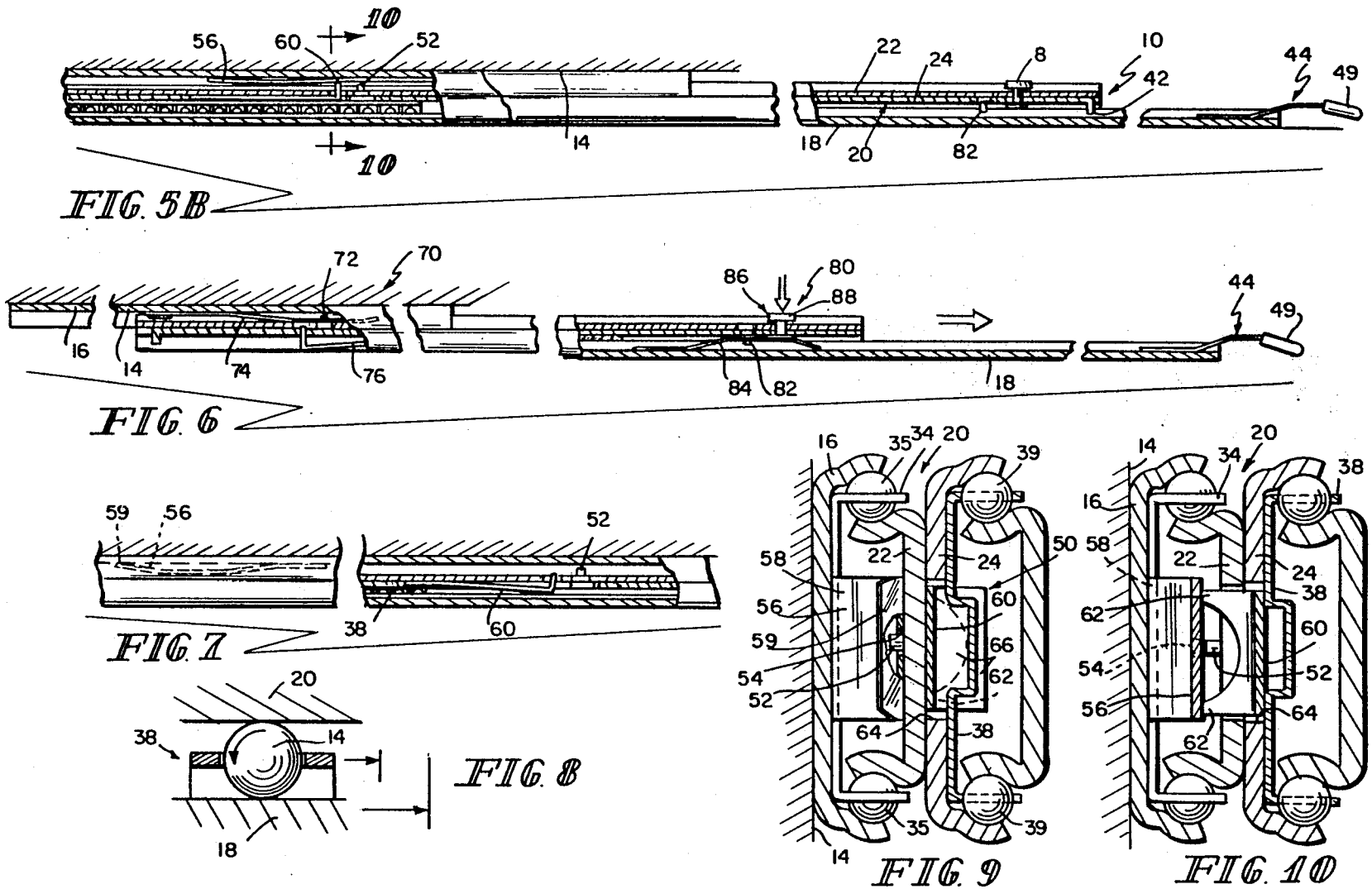
FIG. 6 is a view of the slide assembly in a fully extended position, with the drawer slide member placed in locking engagement with the intermediate slide member and the intermediate slide member being placed in locking engagement with the cabinet slide member.
FIG. 7 is a detail view of the telescoping slide assembly being closed, with the lock between the intermediate and drawer slides broken to allow insertion of the drawer slide member into the cabinet.
FIGS. 8 is a detail view of one of the ball bearings that act in conjunction with a bearing retainer positioned in a channel defined by an outer section of the intermediate slide member to support the drawer slide member.
FIG. 9 is a cross sectional view of FIG. 2 generally across sectional lines 9—9.
FIG. 10 is a cross sectional view of FIG. 5B across sectional lines 10—10 showing the the bearing retainer depressing a lock holding the intermediate slide member and the cabinet slide member in locking engagement.

As best shown in FIG. 9, the support bracket 22 is configured to form an elongated channel having a C-shaped transverse cross section and is supported for sliding movement in the stationary cabinet slide member 16 by a bearing race assembly 34 that is slidable in the cabinet slide member 16. The bearing race assembly 34, best shown in transverse cross section in FIG. 9, contains a plurality of ball bearings 35 arranged to engage both of the cabinet slide member 16 and the support bracket 22 of the intermediate slide member 18. These ball bearings 35 roll in the channel of the support bracket 22 as the intermediate slide member 18 is extended and retracted with respect to the cabinet slide member 16.

The outer section 24 is also configured to define a channel having a transverse cross section in the form of an elongate C-shape that is mounted on the support bracket 22 so that its channel section opens on the drawer facing side of the intermediate slide member 20. The channel of outer section 24 is formed to receive the drawer slide member 18 therein. As best shown in FIG. 9, a bearing race assembly 38 is retained in the channel of outer section 24 for slidably supporting the drawer slide member 18 in the channel. The bearing race assembly 38 shown in FIGS. 1 and 9 contains a plurality of ball bearings 39 arranged to engage both of the outer section 24 and the drawer slide member 18. These ball bearings 39 roll in the channel of the outer section 24 as the drawer slide member 18 is extended and retracted with respect to the outer section 24.

The direction of rotational motion of a single ball bearing 41 as the drawer slide member 18 is extended is illustrated in FIG. 8. In the embodiment of the invention illustrated in FIGS. 1 and 8, the ball bearings act as friction gears, with movement of the drawer slide member 18 through some distance with respect to the intermediate slide member 20 resulting in movement of the ball bearings and bearing race assembly 38 through half of that distance in the same direction. This 2:1 movement ratio (of the drawer slide member 18 with respect to the bearing race assembly 38) can be varied as desired by modification of the size of the ball bearings. Ball bearings uniformly having a diameter of about 3 millimeters are used in the illustrated embodiment, but use of larger ball bearings will result in an increasing movement ratio, eg. 3:1, 4:1 etc., and use of smaller ball bearings will result in a decreased movement ratio, eg. 1.8:1, 1.5:1, etc.

A spring strip 44 is mounted on the drawer slide member 18 for engaging the outer section 24 during relative movement of the drawer slide member 18 and the outer section 24 to establish a locked connection therebetween. The drawer slide member 18 is retained in a retracted position with respect to the intermediate slide member 20 due to engagement of spring strip 44 and locking lugs 42 on outer section 24 as shown best in FIGS. 1, 2, and 3.

The embodiment of the invention illustrated in the figures has a total of four separate locking mechanisms 40, 50, 70, and 80 that hold the intermediate slide member 20 and the drawer slide member 18 at various positions with respect to the cabinet slide member 18. As generally shown in FIGS. 1 and 2, when the slide assembly 10 is in a fully retracted position such that a drawer is held within the cabinet 14, two locks 40 and 50 are engaged to respectively hold the intermediate slide member 20 fixed with respect to the cabinet slide member 16 and to hold the intermediate slide member 20 fixed with respect to the drawer slide member 18. If these two locks 40 and 50 are broken and the drawer slide member 18 and the intermediate slide member 20 of the slide assembly 10 are extended outward from the cabinet 14, another two locks 70 and 80 act to respectively hold the intermediate slide member 20 in an extended position fixed with respect to the cabinet slide member 16 and to hold the intermediate slide member 20 in an extended position fixed with respect to the drawer slide member 18.

Figure 3:
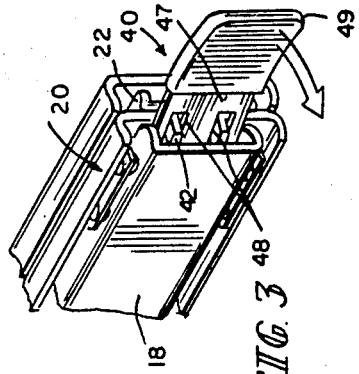
FIG. 3 is an enlarged view of a latch release shown in FIG. 1 in its locked position holding the drawer slide member in locking engagement with the intermediate slide member.

As best shown in FIGS. 1 and 3, a first lock assembly 40 holds the drawer slide member 18 in a retracted position fixed with respect to the intermediate slide member 20. The first lock assembly 40 includes a pair of locking lugs 42 mounted within the channel section of the outer section 24 to project toward the drawer slide member 18. A first spring strip 44 mounted on the drawer slide member 18 (indicated in outline in FIG. 1). The first spring strip is biased so that that a distal end 47 normally extends into the channel of the outer section 24 of the intermediate slide member 20.

The first spring strip 44 is also formed to have a pair of apertures 48 defined in its distal end 47 through which the locking lugs 42 can be projected. When the slide assembly 10 is in its fully retracted position, the locking lugs 42 project through the apertures 48 in the distal end 47 of the first spring strip 44 and cooperate with the first spring strip 44 to hold the drawer slide member 18 in a fixed position relative to the intermediate slide member 20. As indicated by the arrow shown in FIG. 3, the first lock assembly 40 can be released to allow movement of the drawer slide member 18 relative to the intermediate slide member 20 by manually pulling a release tab 49 integrally attached to the distal end 47 of the first lock spring 44 in the direction of the drawer slide member 18. When the locking lugs 42 no longer project through the apertures 48, locking connection by the first lock assembly 40 between the drawer slide member 18 and the intermediate slide member 20 is broken.

As best shown in FIG. 2 and in transverse cross section in FIG. 9, a second lock assembly 50 forms a locking connection between the intermediate slide member 20 and the cabinet slide member 16 when the slide assembly 10 is in a completely retracted position such as illustrated in FIG. 1. The locking engagement is created through entrapment of a pin 52 in an aperture 54 defined by a second spring strip 56. The pin 52 is mounted on the support bracket 22 of the intermediate slide member 20 to project toward the cabinet slide member 16. The second spring strip 56 is mounted at its proximal end 58 to the cabinet slide member 16, and has a distal end 59 biased to extend toward the support bracket 22 of the intermediate slide member 20. The aperture 54 is defined within the distal end 59 of the second spring strip 56. Projection of the pin 52 through the aperture 54 is sufficient to form a locking interconnection between the intermediate slide member 20 and the cabinet slide member 16.

Breaking the locking interconnection between the cabinet slide member 16 and the intermediate slide member 20 is accomplished by depressing the distal end 59 of the second spring strip 56 toward the cabinet slide member 16. As best shown in FIGS. 2, 9 and 10, a second lock release mechanism 60 is an integrally formed metal strip having a pair of depressible digits 62 extending through an aperture 64 in the intermediate slide member 20 and a ramp segment 66 connected at its attached end 68 to the outer section 24 of the intermediate slide member 20. The ramp segment 66 is arranged to extend at an angle toward the drawer slide member 18.

The lock release mechanism 60 is actuated by the movement of the bearing race assembly 38 along the ramp segment 66. Initially contacting the ramp segment 66 at its attached end 68, continued movement of the bearing race assembly 38 along the ramp segment 66 in the direction indicated by the arrows in FIG. 4 acts to depress the ramp segment 66 toward the intermediate slide member 20, which in turn causes movement of the integrally formed depressible digits 62 toward the cabinet slide member 16. These digits 62 effectuate release of the locking interconnection between the intermediate slide member 20 and the cabinet slide member 16 by causing the distal end 59 to be depressed toward the cabinet slide member 16, thereby releasing the pin 52 from its position in the aperture 54 of the second spring strip 56.

As will be appreciated by those skilled in the art, it is not necessary that bearing race assemblies such as illustrated in the figures be used to actuate the lock release mechanism 60. Other forms of lock release members, which may or may not actively support the drawer slide member 18, can also be used in accordance with this invention. For example, a lock release member (not shown) can be positioned between the drawer slide member 18 and the intermediate slide member on rollers or other sliding means so that outward extension of the drawer slide member 18 acts to slide the lock release member (not shown) in the same direction as the drawer slide member 18, thereby triggering a lock release mechanism in the path of sliding movement of the lock release member.

As best shown in FIG. 6, a third lock assembly 70 holds the intermediate slide member 20 in an extended position with respect to the cabinet slide member 16. The third lock assembly 70 includes a pin 72 mounted to project toward the cabinet slide member 16 from the support bracket 22 of the intermediate slide member 20, and a third spring strip 74 defining an aperture (not shown) for accepting the projecting pin 72 and forming a locking interconnection between the cabinet slide member 16 and the intermediate slide member 20. A third lock release assembly 76 causes the third spring strip 74 to be depressed toward the cabinet slide member 16, thereby bringing the pin 72 out of its position in the aperture and breaking the locking interconnection between the intermediate slide member 20 and the cabinet slide member 16.

As best shown in FIG. 6, a fourth lock assembly 80 holds the drawer slide member 18 in an extended position with respect to the intermediate slide member 20. The fourth lock assembly 80 includes a pin 82 mounted to project toward the drawer slide member 18 from the outer section 24 of the intermediate slide member 20, and a fourth spring strip 84 mounted on the drawer slide member 18. The fourth spring strip 84 defines an aperture (not shown) for accepting the projecting pin 82 and in conjunction with the pin 82 forms a locking interconnection between the drawer slide member 18 and the intermediate slide member 20.

A fourth lock release assembly 86 includes a manually actuated button 88 mounted for floating movement on the intermediate slide member 20 adjacent to the pin 82. Pressing the button 88 (as indicated by the arrow in FIG. 6) causes the fourth spring strip 84 to be depressed toward the drawer slide member 18, thereby bringing the pin 82 out of its position in the aperture defined by the fourth spring strip 84 and breaking the locking interconnection between the drawer slide member 18 and the intermediate slide member 20.

Figure 4:
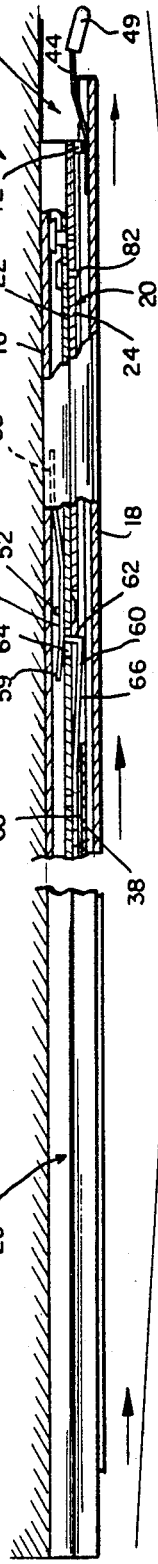
FIG. 4 is a view similar to FIG. 2 showing the slide assembly as the drawer slide member begins to outwardly move away from the cabinet.

In operation, the slide assembly 10 is moved from the fully retracted position shown in FIG. 1 to a fully extended position shown in FIG. 6 in the following manner. The locking interconnection provided by the first lock assembly 40 (that holds the drawer slide member 18 fixed with respect to the intermediate slide member 20) is manually broken by swinging the release tab 49 toward the drawer slide member 18 as shown in FIG. 3. The draw slide member 18 is then pulled slightly forward so that the locking lugs 42 are no longer positioned to protrude through the aperture 48 in the first spring strip 44. Continued movement of the drawer slide member 18 outward from the cabinet 14 as shown in FIG. 4 causes the bearing race assembly 38 to begin moving in the same outward direction as the drawer slide member 18 because the ball bearings retained in the ball bearing assembly 38 act as frictional gears that translate motion of the drawer slide member 18 into motion of the ball bearing assembly 38 (at a 2:1 ratio, so the distance covered with respect to the intermediate slide member 20 by the ball bearing assembly 38 is only half the distance covered by the draw slide member 18). Movement of an individual ball bearing 41 is indicated in FIG. 8, which also indicates the direction of rotation of the ball bearing 41 as the drawer slide member 18 is extended outward.

As the ball bearing assembly 38 moves along the channel formed by the outer section 24, it depresses the ramp segment 66 of the second lock release mechanism 60, forcing the ramp segment 66 toward the intermediate slide member 20, which in turn causes movement of the integrally formed depressible digits 62 toward the cabinet slide member 16. These digits 62 cause release of the locking interconnection between the intermediate slide member 20 and the cabinet slide member 16 by causing the distal end 59 of the second spring strip 56 to be depressed toward the cabinet slide member 16, thereby releasing the pin 52 from its position in the aperture 54 of the second spring strip 56.

When the intermediate slide member 20 is at full extension from the cabinet 14, it is locked into place with respect to the cabinet slide member 16 by the a third lock assembly 70 (best seen in FIG. 6) which holds the intermediate slide member 20 in an extended position with respect to the cabinet slide member 16. The third lock assembly 70 engages the cabinet slide member 16 and the intermediate slide member 20 in locking interconnection when the pin 72 drops into and protrudes through an aperture (not shown) in the third strip spring 74.

Continued outward extension of the drawer slide member 18 results in activation of the fourth lock assembly 80 that engages to prevent further outward extension of the drawer slide member 18. As best shown in FIG. 6, the a fourth lock assembly 80 holds the drawer slide member 18 in an extended position with respect to the intermediate slide member 20 because the pin 82 mounted to project toward the drawer slide member 18 from the outer section 24 of the intermediate slide member 20 and the fourth spring strip 84 mounted on the drawer slide member 18 operably engage in locking interconnection. The fourth spring 84 defines an aperture (not shown) into which the pin 82 drops, locking the drawer slide member 18 and the intermediate slide member 20.

Retraction of the drawer slide assembly 18 into the cabinet 14 is accomplished by reversing the previous procedure, so that the fourth lock assembly 80 is unlocked, followed by unlocking the third lock assembly 70. The second lock assembly 50 is then engaged to provide a locking interconnection between the intermediate slide member 20 and the cabinet slide member 16, and the first lock assembly 40 is engaged to hold the drawer slide member 18 in a retracted position engaging in locking interconnection.

The release of the fourth lock assembly 80 involves manually actuating button 88 positioned on the intermediate slide member 20. Pressing the button 88 (as indicated by the arrow in FIG. 6) causes the fourth spring strip 84 to be depressed toward the drawer slide member 18, thereby bringing the pin 82 out of its position in the aperture defined by the fourth spring strip 84 and breaking the locking interconnection between the drawer slide member 18 and the intermediate slide member 20. The drawer slide member 18 can then be retracted from its extended position, and as shown in FIG. 7 the bearing race assembly 38 is moved back toward its starting position by retraction of the drawer slide member 18.

Although the invention has been described in detail with reference to certain preferred embodiments, variations and modifications exist within the scope and spirit of the invention as described and defined in the following claims.

What is claimed is:

1. A telescoping slide assembly for supporting a movable drawer in a cabinet, the slide assembly comprising a cabinet slide member mounted on the cabinet, a drawer slide member carrying the drawer from a retracted position in the cabinet to an extended position outward from the cabinet, an intermediate slide member slidably interconnecting the cabinet slide member and the drawer slide member, locking means for forming a grasped locking connection between the intermediate slide member and the cabinet slide member to prevent movement of the intermediate slide member relative to the cabinet slide member and breaking means for breaking the grasped locking connection between the intermediate slide member and the cabinet slide member in response to outward movement of the drawer slide member, said breaking means including a lock release member connected to the drawer slide member.

2. The slide assembly assembly of claim 1, wherein the lock release member is attached to the intermediate slide member for sliding movement thereon.

3. The slide assembly of claim 2, wherein the lock release member is positioned for sliding movement between the intermediate slide member and the drawer slide member as the drawer slide is moved outward toward its extended position.

4. The slide assembly of claim 3, wherein the lock release member is attached for sliding movement along the intermediate slide member and further includes supporting means for slidably supporting the drawer slide member to permit sliding movement of the drawer slide member relative to said lock release member.

5. The slide assembly of claim 4, wherein the supporting means further includes a bearing race assembly for retaining a plurality of ball bearings arranged to engage both an outer section of said intermediate slide member and the drawer slide member.

6. The slide assembly of claim 5, wherein movement of the bearing race assembly in response to outward movement of the drawer slide member toward its extended position away from the cabinet breaks grasped the locking connection between the intermediate slide member and the cabinet slide member.

7. The slide assembly of claim 1, wherein the locking means includes a pin mounted on the intermediate slide member to project toward the cabinet slide member and a locking spring mounted on the cabinet slide member and formed to define an aperture capable of accepting said pin, so that a locking interconnection between the cabinet slide member and the intermediate slide member is formed when the pin protrudes through the aperture.

8. A telescoping slide assembly for supporting a movable drawer in a cabinet, the slide assembly comprising a cabinet slide member mounted on the cabinet, a drawer slide member carrying the drawer from a retracted position in the cabinet to an extended position outward from the cabinet, an intermediate slide member slidably interconnecting the cabinet slide member and the drawer slide member, a lock assembly for forming a grasped locking connection between the intermediate slide member and the cabinet slide member that prevents movement of the intermediate slide member relative to the cabinet slide member, said lock assembly including a pin mounted on the intermediate slide member to extend toward the cabinet slide member and engaging means for engaging the pin mounted on the intermediate slide member, said engaging means acting to engage the pin in locking connection, and breaking means for breaking the grasper locking connection between the pin and the engaging means of the lock assembly in response to outward movement of the drawer slide member, said breaking means including a lock release member connected to the drawer slide member.

9. The slide assembly assembly of claim 8, wherein the lock release member is attached to the intermediate slide member for sliding movement thereon.

10. The slide assembly of claim 9, wherein the lock release is positioned for sliding movement between the intermediate slide member and the drawer slide member as the drawer slide is moved outward toward its extended position.

11. The slide assembly of claim 10, wherein the lock release member is attached for sliding movement along the intermediate slide member and further includes supporting means for slidably supporting the drawer slide member to permit sliding movement of the drawer slide member relative to said lock release member.

12. The slide assembly of claim 11, wherein the supporting means further includes a bearing race assembly for retaining a plurality of ball bearings arranged to engage both an outer section of said intermediate slide member and the drawer slide member.

13. The slide assembly of claim 5, wherein movement of the bearing race, assembly in response to outward movement of the drawer slide member toward its extended position away from the cabinet breaks the grasped locking connection between the intermediate slide member and the cabinet slide member.

14. A telescoping slide assembly for supporting a movable drawer in a cabinet, the slide assembly comprising a cabinet slide member mounted on the cabinet, a drawer slide member carrying the drawer from a retracted position in the cabinet to an extended position outward from the cabinet, an intermediate slide member slidably interconnecting the cabinet slide member and the drawer slide member, locking means for forming a grasped locking connection between the intermediate slide member and the cabinet slide member including a pin mounted on the intermediate slide member to project toward the cabinet slide member and a locking spring mounted on the cabinet slide member at a distal end and extending toward the intermediate slide member, the locking spring formed to define an aperture capable of accepting said pin so that a grasped locking interconnection between the cabinet slide member and the intermediate slide member is formed when the pin protrudes through the aperture, and a lock release member positioned between the intermediate slide member and the drawer slide member and including a bearing race assembly having retaining means for retaining a plurality of ball bearings arranged to engage both an outer section of said intermediate slide member and the drawer slide member so that sliding movement of said bearing race assembly in response to outward movement of the drawer slide member toward its extended position away from the cabinet breaks the locking connection between the intermediate slide member and the cabinet slide member.

15. A telescoping slide assembly for supporting a movable drawer in a cabinet, the slide assembly comprising a cabinet slide member mounted on the cabinet, a drawer slide member carrying the drawer from a retracted position in the cabinet to an extended position outward from the cabinet, an intermediate slide member slidably interconnecting the cabinet slide member and the drawer slide member, a lock assembly for forming a grasped locking connection between the intermediate slide member and the cabinet slide member that prevents movement of the intermediate slide member relative to the cabinet slide member, and a lock release member movably attached to the intermediate slide member for movement thereon and further coupled to the drawer slide member so that outward movement of the drawer slide member acts to break the grasped locking connection between the intermediate slide member and the cabinet slide member maintained by the lock assembly.

16. The slide assembly of claim 15, wherein the lock release member is positioned for sliding movement between the intermediate slide member and the drawer slide member as the drawer slide is moved outward toward its extended position.

17. The slide assembly of claim 16, wherein the lock release member is attached for sliding movement along the intermediate slide member and further includes supporting means for slidably supporting the drawer slide member to permit sliding movement of the drawer slide member relative to said locking member.

18. The slide assembly of claim 17, wherein the supporting means further includes a bearing race assembly for retaining a plurality of ball bearings arranged to engage both an outer section of said intermediate slide member and the drawer slide member.

19. The slide assembly of claim 5, wherein movement of the bearing race assembly in response to outward movement of the draw slide member toward its extended position away from the cabinet breaks the locking connection between the intermediate slide member and the cabinet slide member.

* * * * *